US005669653A

United States Patent [19]

Penisson

[11] Patent Number: 5,669,653

[45] Date of Patent: Sep. 23, 1997

[54] FLUID POWERED BACKUP TONG AND METHOD

[75] Inventor: Dennis J. Penisson, Raceland, La.

[73] Assignee: Bilco Tools, Inc., Houma, La.

[21] Appl. No.: 539,356

[22] Filed: Oct. 5, 1995

[51] Int. Cl.[6] ..... B25B 13/50

[52] U.S. Cl. ..... 294/116; 294/88; 81/57.33

[58] Field of Search ..... 294/86.1, 86.3, 294/88, 106, 115, 116; 81/57.15, 57.16, 57.18, 57.19, 57.2, 57.21, 57.33, 57.34, 57.35

[56] References Cited

U.S. PATENT DOCUMENTS

| | | | |
|---|---|---|---|
| 2,639,894 | 5/1953 | Smith . | |
| 3,023,651 | 3/1962 | Wallace | 81/57.18 |
| 3,350,132 | 10/1967 | Ashton | 294/116 |
| 4,463,635 | 8/1984 | Hafla et al. | 294/116 |
| 4,604,922 | 8/1986 | Soutsos | 81/57.18 |
| 4,649,777 | 3/1987 | Buck . | |
| 5,118,248 | 6/1992 | Brucher | 294/88 |
| 5,542,318 | 8/1996 | Wesch, Jr. | 81/57.33 |

FOREIGN PATENT DOCUMENTS

| | | | |
|---|---|---|---|
| 582175 | 11/1977 | U.S.S.R. | 294/116 |

OTHER PUBLICATIONS

Drawing, Weatherford 50–001, undated.

*Primary Examiner*—Dean Kramer
*Attorney, Agent, or Firm*—Browning Bushman

[57] ABSTRACT

The backup tong 10, 110 includes a fluid powered cylinder assembly 72, 172. A wedge 80, 180 is provided at the end of a cylinder rod 76, 176 and forces multiple dies into gripping engagement with the tubular. A pair of links 30, 32 or 130, 132 are driven laterally outward from the centerline 28, 128 of the tong body by the wedge 80, 180, thereby forcing the dies to bite the tubular. The design of the tong is relatively simple and has few moving parts, yet is highly rugged and dependable. Dies 62, 64 and 66 or 162, 164 and 166 may together provide circumferential engagement of at least 270° with a tubular, thereby reliably gripping and minimizing damage to the tubular. The tong 10 includes a door jaw latch pin 58, and is particularly well suited for use on dual tubing strings where there is little axial spacing between the tubing strings.

20 Claims, 3 Drawing Sheets

FLUID POWERED BACKUP TONG AND METHOD

FIELD OF THE INVENTION

The present invention relates to backup tongs of a type commonly used to grip an oilfield tubular in a string extending into a hydrocarbon recovery well. More particularly, this invention relates to a backup tong which includes a wedge powered by a hydraulic cylinder. The backup tong has relatively few moving parts, and is well suited for use on a dual tubing string.

BACKGROUND OF THE INVENTION

Backup tongs are well known tools use in hydrocarbon recovery operations. Rotary tongs typically grip and rotate an upper oilfield tubular to make up or break apart a threaded connection, while backup tongs grip the lower oilfield tubular to prevent its rotation by the power tong. Assuming a lower oilfield tubular is rotationally fixed, the backup tong frequently provides the structure which prevents rotation of the power tong. A load cell between the backup tong and the rotary tong may thus determine the torque applied to the connection. Manual backup tongs are commonly employed in oilfield operations, although fluid powered backup tongs are increasingly used to reduce the time required to make up and break apart threaded connections. The backup tong ideally functions to uniformly and reliably grip the tubular without damaging the tubular due to excessive gripping force. An early version of a rotating tong cooperating with a backup tong is disclosed in U.S. Pat. No. 2,639,894.

Prior art backup tongs have used one more hydraulic cylinders to force dies into gripping engagement with a tubular. U.S. Pat. No. 4,649,777 discloses a backup tong with three gripping dies each powered by a respective hydraulic cylinder assembly. A wedge powered by a hydraulic cylinder has previously been employed for obtaining the desired mechanical advantage. Prior art powered backup tongs are, however, generally complex with numerous moving parts. Also, some powered backup tongs are not designed so that the dies uniformly grip the tubular, thereby marring or otherwise damaging the tubular. Oilfield tubulars including a chrome or other protective coating and oilfield tubulars made from non-ferrous materials are increasingly used in hydrocarbon recovery operations. Both rotary tongs and backup tongs which will not mar these tubulars are thus desired and have long been in demand.

One problem which is long plagued hydrocarbon recovery operations is a difficulty associated with reliably making up and breaking apart tubulars in a dual tubing string. Dual tubing strings are typically provided on six inch centers, and most backup tongs require that the tubing string be spread apart so that the backup tong may be spaced between the dual tubulars. Extra time is required to spread apart the tubulars when making up each connection. Moreover, to enable the tubulars to be spread apart sufficiently to accommodate the backup tong and the rotary tong, the tongs generally must be positioned high above the rig floor, thereby making the threaded and unthreaded operations more difficult and time consuming.

The disadvantages of the prior art are overcome by the present invention, and improved and relatively simple yet highly reliable powered backup tong is hereinafter disclosed which overcomes these and other problems associated with prior art tongs.

SUMMARY OF THE INVENTION

A suitable embodiment of a powered backup tong according to the invention includes a single fluid powered cylinder spaced between upper and lower cover plates which are part of the backup tong body. A generally V-shaped wedge is mounted on the rod end of the hydraulic cylinder assembly, and the cylinder assembly is arranged so that rod extension presses the wedge away from the tubular. A pair of links on opposing sides of the tong centerline are each pivotally mounted on the backup tong body, and are engaged by the wedge to move between a pipe release position and a pipe grip position. A door jaw is pivotally mounted to each link. The pair of door jaws move between an open position for laterally moving the backup tong on and off the pipe, and a closed position wherein the cantilevered ends of the door jaws may be latched together.

The backup tong includes three dies which each engage the tubular along an arc of more than 90°, thereby together providing substantially full circumferential die coverage of at least 270°. One die is mounted on each of the movable door jaws. A third die is provided on a third jaw which is either fixed to or has limited movement with respect to the tong body and is spaced radially opposite the open throat of the tong with respect to the tubular gripped by the dies. The third jaw may be pressed into engagement with the tubular by the cylinder end of the hydraulic cylinder assembly.

According to the method of the invention, the door jaws are initially in their open position so that the backup tong may be moved laterally on and off the tubular and into engagement with the third jaw. The door jaws are then closed and latched together with a latch pin. Each of the three dies do not fully engage the tubular at this stage, thereby facilitating easy latching of the door jaws. The hydraulic cylinder assembly may then be activated at a selected hydraulic pressure, thereby moving the wedge away from the pipe and forcing each link outwardly from the tong centerline. This pivoting movement of the links brings each of the door jaws into engagement with the tubular. The cylinder activation simultaneously presses the third jaw into engagement with the tubular. The angle of the wedge and the resilience of the material between the cylinder assembly and the third die may be selected to obtain the desired compressive force on the tubular from each of the three dies. The hydraulic cylinder assembly may then retract the wedge, thereby releasing the dies from gripping engagement with the pipe. The latch pin may then be removed and the door jaws moved to their open position, thereby allowing the backup tong to be moved laterally off the tubular string.

It is an object of the present invention to provide an improved backup tong which utilizes a wedge powered by a fluid cylinder assembly for simultaneously forcing multiple dies into gripping engagement with the tubular. It is a further object of the invention to provide an improved backup tong which has relatively few moving parts, and which utilizes a design wherein the dies be properly aligned for reliably gripping the tubular without marring or otherwise damaging the tubular.

It is a feature of the present invention that a backup tong may include three dies, with two of the dies being provided on opposing door jaws which may be opened and closed about the tubular. The door jaws may be closed and the cantilevered ends structurally interconnected. A third jaw preferably is provided opposite the throat of the backup tong relative to the oilfield tubular.

It is a further feature of the invention to provide a backup tong with a pair of links which each pivot with respect to the tong body. The links are moved in response to linear movement of a wedge driven by the actuation of the cylinder assembly, thereby forcing each of the dies into gripping engagement with the oilfield tubular. In a preferred embodiment of the invention, the hydraulic cylinder assembly and the wedge are arranged such that the wedge moves away from the oilfield tubular, and each of the links move laterally away from the centerline of the backup tong as the dies are forced into gripping engagement with the tubular.

It is an advantage of the present invention that the backup tong provides substantially full circumferential die coverage for gripping engagement with the tubular. High biting forces may be transmitted from the backup tong to the tubular utilizing dies with extremely fine teeth, thereby preventing marring or other damage to the tubular. It is a further advantage of the invention that the backup tong is constructed such that the tong may be easily used to make up and break apart dual tubular strings on relatively close centers, with a minimal or no lateral spreading of the tubulars.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
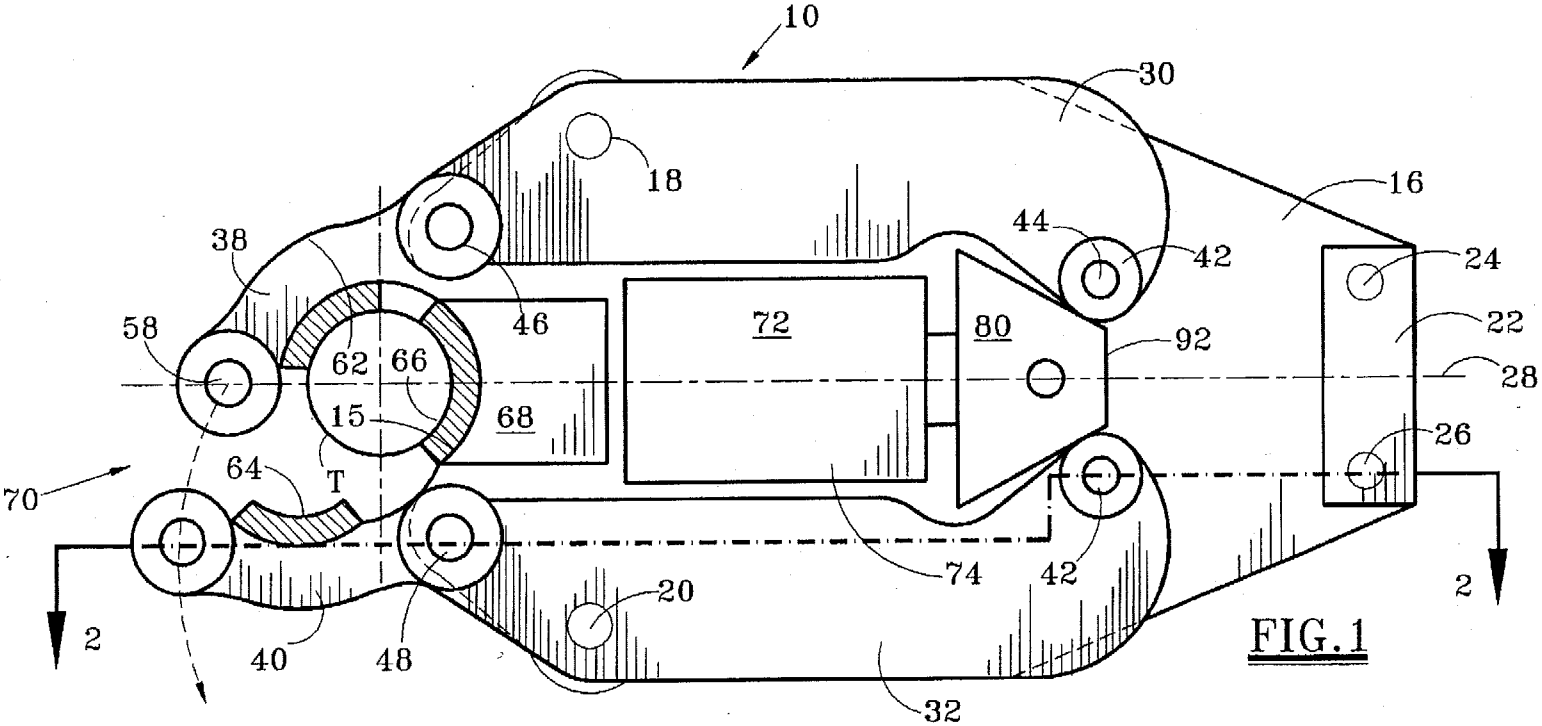
FIG. 1 is a top view of one embodiment of the backup tong according to the present invention, illustrating the backup tong hydraulic cylinder assembly in the pipe release position. The upper door jaw is shown in the closed position and the lower door jaw is shown in an open position for laterally moving the backup tong on and off a tubular.
Figure 2:
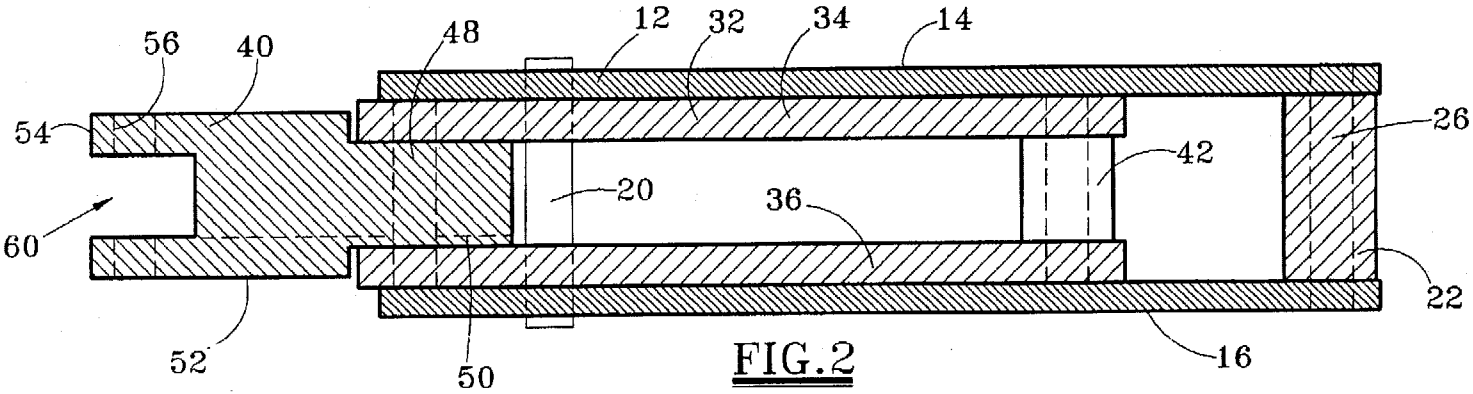
FIG. 2 is a cross-sectional view of the power tong as shown in FIG. 1 through lines 2—2 in FIG. 1.

FIGS. 1 and 2 depict one embodiment of a backup tong 10 according to this invention. The tong body 12 includes upper and lower cover plates 14 and 16, respectively, which are structurally separated by a pair of link pins 18 and 20 in the front end of the backup tong, and by a rear block 22 and a pair of securing pins 24 and 26 at the rear end of the tong. The upper cover plate 14 is removed in the FIG. 1 illustration, and the configuration of the structurally identical bottom cover plate is thus shown partially in dashed lines in FIG. 1. The curved front portion 15 of each plate 14 and 16 is configured for receiving the tubular T within the tong. Also, the tong body 12 may be provided with side plates between the cover plates, although tong side plates which completely encapsulate the inner components within the tong body 12 will have to be spaced sufficiently from the centerline 28 to accommodate movement of the links, as shown in FIG. 3.

A pair of links 30 and 32 are each mounted on the tong body 12 on opposing sides of the tong centerline 28 and between plates 14 and 16, as shown in FIG. 2. Each pair of links may include an upper link plate 34 and a lower link plate 36. The link plates are vertically separated at their front end by a respective jaw block or door jaw 38, 40, and at their rear end by a pair of rollers 42 each mounted on a pin 44 extending between the link plates 34 and 36. Each of the links 30 and 32 pivots with respect to the tong body 12 about the respective link pivot pin 18, 20. Each of the door jaws 38 and 40 are pivotally mounted to a respective link 30, 32 by one of the pair of jaw pivot pins 46, 48 which extend between a respective pair of the link plates 34, 36. The rear end 50 of each door jaw is thus spaced between a respective pair of link plates 34, 36. The cantilevered front end 52 of each door jaw is provided with an interlocking member 54 having an aperture 56 therein for receiving a latch pin 58. As shown in FIGS. 1 and 2, the door jaw 40 has upper and lower interlocking members, and a single latch member on the jaw 38 may thus fit in the recess 60 between these members so that the apertures 56 in each of the door jaws may be aligned for receiving a common latch pin 58.

FIG. 1 depicts the jaw 40 in the open position and the jaw 38 in the closed position. In practice, those skilled in the art will understand that both the door jaws 38 and 40 may be opened so that the backup tong may be moved laterally for placing the backup tong on and off an oilfield tubular T extending vertically through a well. Each of the door jaws 38, 40 include a die 62, 64 mounted thereon, and another die 66 mounted on jaw 68 is provided opposite the opened throat 70 of the backup tong. Those skilled in the art will appreciate that the tong may be moved on and off the tubular in a direction generally aligned with the centerline 28 of the tong. Once the backup tong has been positioned so that the tubular T engages the die 68, both the door jaws 38 and 40 may be closed, and a pin 58 inserted through the apertures 56 in the pair of door jaws so that the interconnected jaws and the tong body fully encircle the tubular T. It should be understood that, in this position, each of the jaws 62 and 64 typically will not engage the tubular T, and instead a slight gap will exist between the dies 62, 64 and the tubular T, thereby facilitating the closing of both door jaws 38, 40 and the positioning of the pin 50 for interconnecting these jaws. A slight gap is thus depicted in FIG. 1 between the closed door jaw die 62 and the tubular T. During this operation, the cylinder 72 remains in its retracted position, as shown in FIG. 1.

Figure 3:
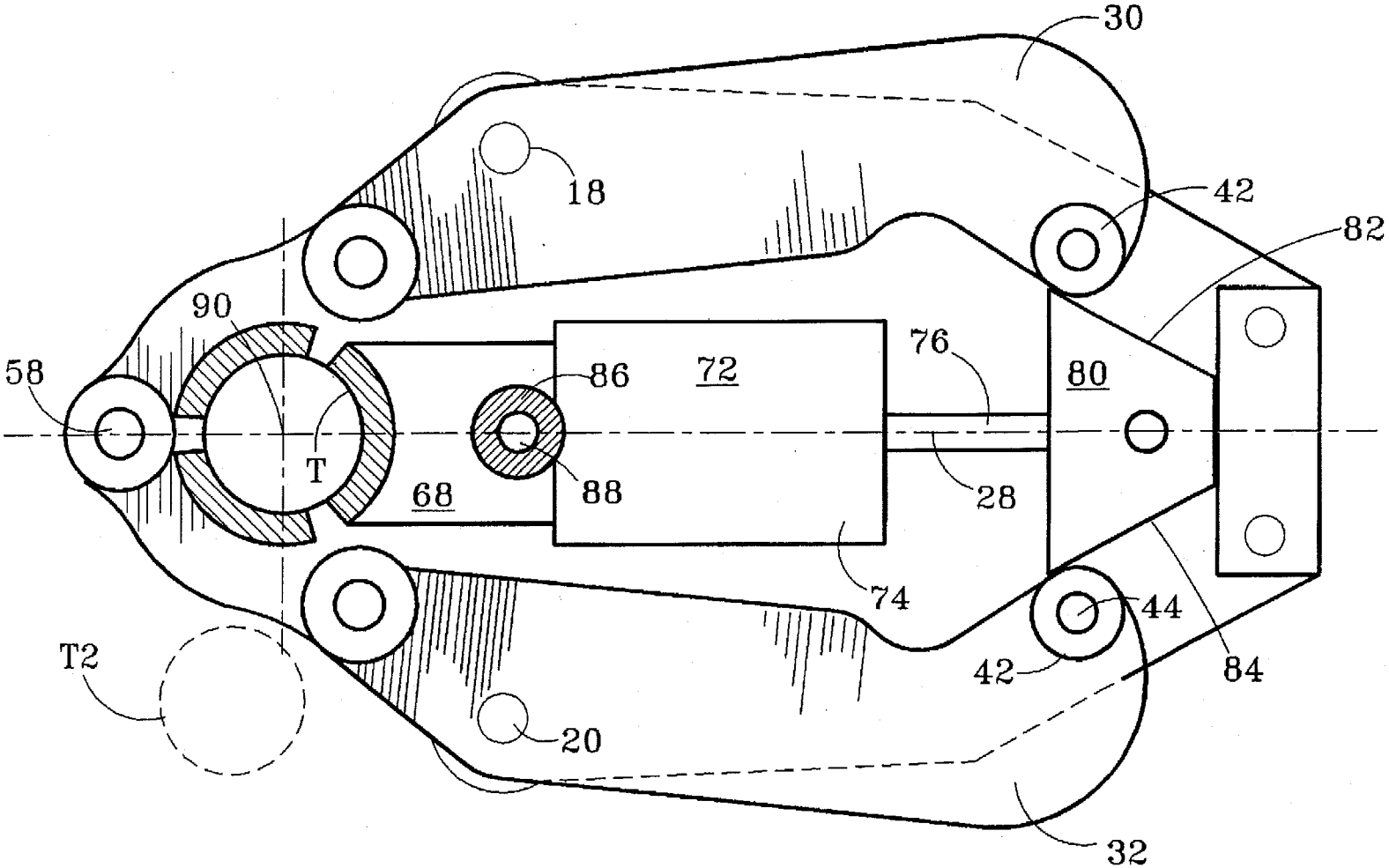
FIG. 3 is a top view of a backup tong similar to the tong shown in FIGS. 1 and 2. The hydraulic cylinder assembly has been activated for bringing the dies into gripping engagement with the oilfield tubular.

Referring to FIGS. 1 and 3, a fluid powered cylinder assembly 72 is provided between the cover plates 14 and 16, and laterally between the links 30 and 32. Preferably a centerline of the cylinder assembly 72 is aligned with the centerline 28 of the tong. The cylinder portion 74 of the cylinder assembly may be structurally secured to both the upper and lower cover plates 14 and 16 by conventional securing members (not shown). The cylinder assembly is provided with a rod end 76 which carries a wedge 80 thereon. The rod end and the wedge are linearly movable along the centerline 28 of the tong, and preferably are arranged such that the rod 76 extends from the cylinder body 74 to move the wedge 80 away from the tubular T when the cylinder assembly 72 is activated for gripping the tubular. The wedge 80 is provided with tapered camming surfaces 82 and 84 which each engage a respective roller 42 mounted at the rear end of a respective link 30, 32 when activating the cylinder assembly 72. The wedge 80 thus pivots the links 30 and 32 about the pivot pins 18 and 20, and drives each of the links 30 and 32 outward from the centerline 28, as shown in FIG. 3.

According to one embodiment of the invention, as shown in FIG. 1, the cylinder housing 72 is fixed to the tong plates 14, 16, and the jaw 68 is similarly fixed between the cover plates 14 and 16. According to another embodiment, as shown in FIG. 3, the cylinder assembly 72 is spaced between the tong plates 14 and 16 so that it is maintained on the centerline 20, although the cylinder assembly is free to move in a direction along the centerline 28. According to this alternate embodiment as shown in FIG. 3, the jaw 68 is similarly mounted between the cover plates 14 and 16 in a manner such that limited movement of the jaw 68 in a direction along the axis 28 is possible. In this embodiment, a resilient material sleeve 86 is mounted on a pin 88 which extends between the cover plates 14 and 16. Pin 88 is fixed to the jaw 68, and slides within a short slot (not depicted) in both the upper and lower cover plates 14 and 16 for allowing limited movement of the fixed jaw 68 and thus the die 66 thereon in a direction along centerline 28. During activation of the cylinder assembly 72, the cylinder body 70 may press against the resilient material sleeve 86, while the wedge 80 simultaneously forces the links 30 and 32 outward, as shown in FIG. 3. By allowing the rear end of the cylinder assembly 72 to press against the resilient sleeve 86, limited movement of the jaw 68 is possible, thereby allowing the die 66 to move slightly to increase its gripping force on the tubular T.

Once the cylinder assembly 72 has been activated, it may be seen that the lateral movement of the links 30 and 32 brings each of the door jaws 38 and 40 inwardly toward the central axis 90 of the tubular T, thereby bringing each of the jaws 62, 64 and 66 into gripping engagement with the tubular T. During this operation, the pin 58 also functions as a hinge to allow each of the dies 62, 64 and 66 to achieve a biting engagement with the tubular T without marring or damaging the tubular. Relatively fine teeth may be provided on each of the dies for gripping engagement with the tubular. Preferably each of the dies 62, 64 and 66 occupies a circumferential length of at least 90° for engaging the tubular, so that the circumference of the three dies in engagement with the tubular is greater than 270°, and preferably is greater than 300° when the dies grip the tubular, as shown in FIG. 3. The design of the backup tong 10 as described herein achieves a very tight grip on the tubular utilizing a single cylinder assembly, and includes relatively few moving parts.

Cylinder assembly 72 may be activated in response to either air or hydraulic fluid, although preferably hydraulic fluid is used to activate the cylinder assembly. When pressure is applied to the cylinder assembly 72, the rod 76 extends from the cylinder body 74 so that the wedge moves each of the links laterally outward and tightens the door jaws against the tubular. To disconnect the backup tong 10 from gripping engagement with the tubular, hydraulic fluid is applied to the cylinder assembly 72 to retract the rod 76 and return the wedge to the position as shown in FIG. 1. The pin 58 may then be easily removed from the jaw doors 38, 40, and the doors each moved to an open position so that the tong may be moved laterally off the tubular T.

By positioning the cylinder assembly so that the wedge 80 moves in a direction away from the tubular T when gripping the tubular, the mechanical advantage of the links 30 and 32 is maximized without increasing the size of the tong. The pivot pins 18 and 20 are thus preferably spaced toward the front end of the tong body 12, and force is applied to the rear end of the links 30 and 32 through the wedge 80. The front end of end link 30, 32 is thus forced slightly toward the centerline 28. The door jaws 38 and 40 are pivotally connected to the front end of the links, and thus are driven toward the central axis 90 of the tubular T to bring the dies into biting engagement with the tubular T. Also, the arrangement as shown in FIG. 3 allows both the cylinder rod 76 and the cylinder body 74 to be functionally used to assist in biting engagement of the dies with the pipe, as explained above.

The block 22 also functions as a stop for engaging the end 92 of the wedge 80, thereby preventing application of too much biting force on the tubular T. Those skilled in the art will appreciate that the cam sides 82 and 84 of the wedge 80 may be configured for increasing or decreasing the biting force applied by the dies 62 and 64. Due to the substantial mechanical advantage obtained by the arrangement of the links 30 and 32 as disclosed herein, each of these cam wedges according to the present invention may have a substantially large cam angle of from about 20° to 40° with respect to the centerline 28 of the backup tong. According to the preferred embodiment of the invention, the camming angle of the sides 82 and 84 of the wedge 80 is arranged at from about 27° to about 33° with respect to the centerline 28 of the tong.

A significant advantage of the embodiments as shown in FIGS. 1 and 3 is that the tong 10 may operate with a very small space provided between the tubular T and another tubular, which may be positioned adjacent either the door jaw 38 and the door jaw 40 and between the pins 58 and 46 or 48, respectively. The tong as shown in FIGS. 1 and 3 may thus be laterally moved to engage one tubular therein, while a second tubular T2, as shown in dashed lines in FIG. 3, is provided adjacent the gripped tubular. At least one and preferably both the door jaw 38 and 40, is configured such that the door jaw has a relatively thin body portion between the respective pivot 46, 48 and the door latch device 58. The relatively thin portion of the door jaw has a body thickness which is less than 3 inches, and preferably less than about 2.5 inches, so that another tubular may be positioned immediately exterior of the closed and latched door jaw, as shown in FIG. 3. The backup tong 10 is thus well suited for use in dual tubing strings, wherein the lateral spacing between the centerline of the dual tubulars is six inches or only slightly greater than six inches. This design accordingly allows the tong to be easily moved on and off the tubular, as disclosed herein.

Figure 4:
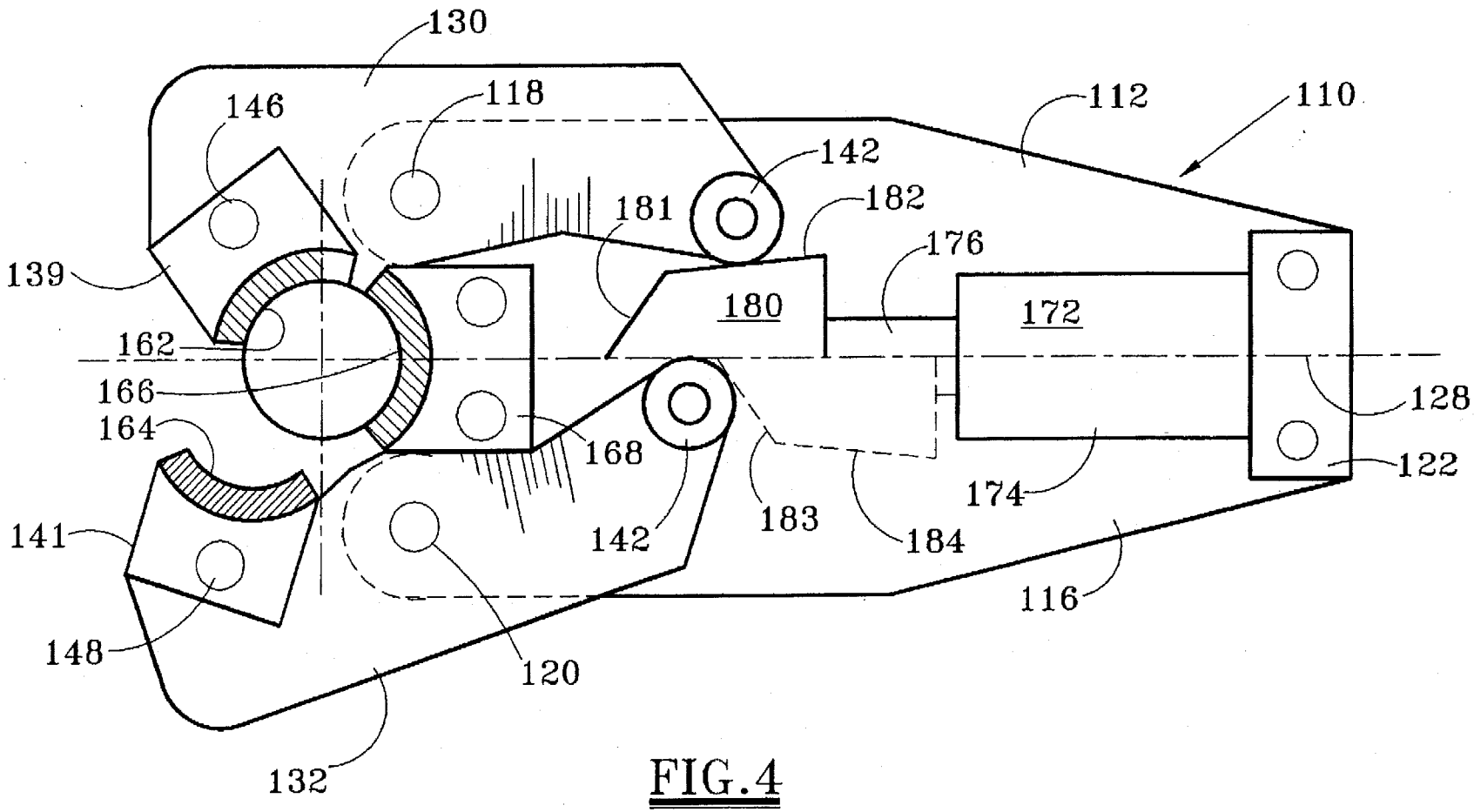
FIG. 4 is a top view of an alternate embodiment of a backup tong according to the present invention. The backup tong on the top side of the centerline in FIG. 4 is shown in gripping engagement with the tubular, while the backup tong on the bottom side of the tong centerline is shown in the pipe released position.

FIG. 4 discloses an alternate embodiment of a backup tong 110 with a tong body 112 which includes upper and lower tong plates as discussed above. Again, the upper tong plate has been removed in the FIG. 4 illustration, and the outline of the lower tong plate 116 is depicted.

In the FIG. 4 embodiment, the cylinder assembly 172 is mounted within the body 112 with the cylinder housing 174 fixed to the rear block 122. The rod end 176 thus projects inwardly toward the tubular T when the cylinder assembly is activated for gripping engagement with the tubular. A pair of links 130 and 132 are provided on opposing sides of the tong centerline 128 and pivot about link pivot pins 118 and 120 secured between the tong plates. The wedge 180 at the end of the rod 176 includes a pair of first tapered surfaces 181 and 183 which have a very high cam angle for initially bringing the dies toward engagement with the pipe. Wedge 80 also has a pair of lower cam angle surfaces 182 and 184 which function to bring the dies into final gripping engagement with the pipe. In a suitable embodiment, the surfaces 181 and 183 may be angled at approximately 45° relative to the centerline 128, while the surfaces 182 and 184 ar each inclined at a lower and thus more powerful cam angle of from 6° to about 10°.

A roller 142 is fixed to the rear end of each link 130 and 132, and engages the wedge 118 in a manner previously described for rollers 42. When the cylinder assembly 172 is activated, the wedge forces the rear end of each link 130, 132 laterally outwardly from the centerline 128, thereby pivoting each link about a respective pin 118, 120 and forcing each of the dies 162 and 164 into gripping engagement with the tubular T.

Head 168 is fixed to the tong body, and supports die 166 thereon. A jaw block 139 and 141 is pivotally mounted on the front end of each of the links 130 and 132 by a respective pin 146 and 148. The pin allows each of the jaw blocks 139 and 141 to rotate slightly, thereby allowing each die 162 and 164 to become perfectly aligned for gripping engagement with the tubular T. By allowing each die 162 and 164 to pivot slightly with respect to the respective link 130 and 132, each of the three dies 162, 164 and 166 may become properly aligned for gripping engagement with the tubular without marring or damaging the tubular.

The design as shown in FIG. 4 is well suited for tongs designed for engaging large diameter tubulars where the space allows for larger jaws. The advantage of the design as shown in FIG. 4 is that the jaws tightly grip the tubular without the need for a door latch. The FIG. 4 design, like the previously described designs, is relatively simple and has few parts. Each of the dies may be perfectly aligned with the tubular. Additional links and additional cylinders are not required to open and close doors or force the dies into gripping engagement with the tubular.

For each of the embodiments described herein, each of the links, the door jaws and the jaw blocks is preferably pivotally connected to its respective support member by a pivot pin. High reliability and trouble free operation of the tong are obtained, at least in part, by not utilizing slots or similar arrangements which provide "play" between these components to enable the dies to engage the tubular. Each pivot pin thus allows for rotation of one component about the other and movement between these respective components is practically limited to rotational movement.

Although the invention has thus been described in detail for certain embodiments, it should be understood that this explanation is for illustration, and that the invention is not limited to these embodiments. Alternative equipment and operating techniques will thus be apparent to those skilled in the art. In view of this disclosure, modifications are thus contemplated and may be made without departing from the spirit of the invention, which is defined by the claims.

What is claimed is:

1. A backup tong for gripping engagement with an oilfield tubular, comprising:

a tong body having a throat for laterally moving the tong body on and off the oilfield tubular in a direction generally aligned with a centerline of the tong body;

a first link pivotally mounted to the tong body about a first pivot;

a second link pivotally mounted to the tong body about a second pivot;

a first jaw block pivotally mounted to the first link about a third pivot, the first jaw block supporting a first die thereon for gripping engagement with the oilfield tubular;

a second jaw block pivotally mounted to the second link about a fourth pivot, the second jaw block supporting a second die thereon for gripping engagement with the oilfield tubular;

a hydraulic cylinder assembly mounted on the tong body and having a cylinder body and a cylinder rod extending from the cylinder body, the hydraulic cylinder assembly being mounted on the tong body such that the cylinder rod is movable along the centerline of the tong body; and a wedge mounted on the cylinder rod, the wedge having first and second cam surfaces thereon provided on opposing sides of the centerline of the tong body for engagement with the first and second links, respectively, to force the first and second dies into gripping engagement with the oilfield tubular, each of the first and second cam surfaces having an initial high cam angle for moving the dies toward engagement with the tubular, and a subsequent low cam angle inclined at an angle less than the high cam angle with respect to the centerline of the tong body for gripping engagement of the respective first die and the second die with the oilfield tubular.

2. The backup tong as defined in claim 1, further comprising:

each of the first jaw block and second jaw block being pivotally movable with respect to the first link and the second link, respectively, between an open position for laterally receiving the tong body on the oilfield tubular and a closed position for retaining the tubular within the tong body; and a latch device for selectively interconnecting the first and second jaw blocks.

3. The backup tong as defined in claim 1, wherein the cylinder assembly is mounted on the tong body such that extension of the cylinder rod pushes the wedge along the centerline of the tong body and away from the oilfield tubular.

4. The backup tong as defined in claim 1, wherein:

each of the first and second links is pivotally mounted to a front portion of the tong body, and the wedge engages a rear end of each of the first and second links.

5. The backup tong as defined in claim 1, further comprising:

a third jaw block mounted on the tong body and supporting a third die thereon for gripping engagement with the oilfield tubular.

6. The backup tong as defined in claim 5, wherein a circumferential gripping length of each of the first die, the second die, and the third die which engage the oilfield tubular is at least 90°, such that the dies grippingly engage a total circumference of at least 270° of the oilfield tubular.

7. The backup tong as defined in claim 5, comprising:

the third jaw block being movable with respect to the tong body;

the cylinder body being movably mounted with respect to the tong body; and the cylinder body acts against the third jaw block for forcing the third die into gripping engagement with the oilfield tubular.

8. The backup tong as defined in claim 7, further comprising:

a resilient member for positioning between the cylinder body and the third jaw block, such that compression of the resilient member forces the third die into gripping engagement with the oilfield tubular.

9. The backup tong as defined in claim 1, wherein each of the first and second cam surfaces on the wedge have a cam angle of from 20° to 40° with respect to the centerline of the tong body.

10. The backup tong as defined in claim 1, further comprising:

a first roller and second roller each mounted on the first and second link, respectively, for engaging the respective cam surface on the wedge.

11. A backup tong for gripping engagement with an oilfield tubular, comprising:

a tong body having a throat for laterally moving the tong body on and off the oilfield tubular in a direction generally aligned with a centerline of the tong body, the tong body including upper and lower spaced apart tong plates;

a first link pivotally mounted to the tong body about a first pivot and spaced between the upper and the lower tong plates;

a second link pivotally mounted to the tong body about a second pivot and spaced between the upper and the lower tong plates;

a first jaw block pivotally mounted to the first link about a third pivot, the first jaw block supporting a first die thereon for gripping engagement with the oilfield tubular;

a second jaw block pivotally mounted to the second link about a fourth pivot, the second jaw block supporting a second die thereon for gripping engagement with the oilfield tubular;

a third jaw block mounted on the tong body between the upper and the lower tong plates and supporting a third die thereon for gripping engagement with the oilfield tubular;

a hydraulic cylinder assembly mounted on the tong body between the upper and the lower tong plates, the hydraulic cylinder assembly including a cylinder body and a cylinder rod extending from the cylinder body; and a wedge mounted on the cylinder rod, the wedge having first and second cam surfaces thereon for engagement with the first and second links, respectively.

12. The backup tong as defined in claim 11, further comprising:

each of the first jaw block and second jaw block being pivotally movable with respect to the first link and the second link, respectively, between an open position for laterally receiving the tong body on the oilfield tubular and a closed position for retaining the tubular within the tong body; and a latch device for selectively interconnecting the first and second jaw blocks.

13. The backup tong as defined in claim 12, wherein at least one of the first jaw block and the second jaw block have a body thickness between the respective one of the third and fourth pivot and the latch device which is less than about 2.5 inches, such that the backup tong may be laterally moved on one string of a dual tubing string.

14. The backup tong as defined in claim 13, wherein the cylinder assembly is mounted on the tong body such that extension of the cylinder rod pushes the wedge along the centerline of the tong body and away from the oilfield tubular.

15. The backup tong as defined in claim 13, wherein each of the first and second cam surfaces on the wedge have a cam angle of from 20° to 40° with respect to the centerline of the tong body.

16. A backup tong for gripping engagement with an oilfield tubular, comprising:

a tong body having a throat for laterally moving the tong body on and off the oilfield tubular in a direction generally aligned with a centerline of the tong body;

a first link pivotally mounted to the tong body about a first pivot;

a second link pivotally mounted to the tong body about a second pivot;

a first jaw block pivotally mounted to the first link about a third pivot, the first jaw block supporting a first die thereon for gripping engagement with the oilfield tubular;

a second jaw block pivotally mounted to the second link about a fourth pivot, the second jaw block supporting a second die thereon for gripping engagement with the oilfield tubular;

a third jaw block mounted on the tong body and supporting a third die thereon for gripping engagement with the oilfield tubular;

a hydraulic cylinder assembly mounted on the tong body, the hydraulic cylinder assembly including a cylinder body and a cylinder rod extending from the cylinder body, and a wedge mounted on the cylinder rod, the wedge having first and second cam surfaces thereon for engagement with the first and second links, respectively.

17. The backup tong as defined in claim 16, wherein the cylinder assembly is mounted on the tong body such that extension of the cylinder rod pushes the wedge along the centerline of the tong body.

18. The backup tong as defined in claim 16, further comprising:

each of the first and second links is pivotally mounted to a front portion of the tong body, and the wedge engages a rear end of each of the first and second links; and a first roller and second roller each mounted on the first and second link, respectively, for engaging the respective cam surface on the wedge.

19. The backup tong as defined in claim 16, further comprising:

each of the first jaw block and second jaw block is movable between an open position for laterally receiving the tong body on the oilfield tubular and a closed position for retaining the tubular within the tong body.

20. The backup tong as defined in claim 19, wherein actuation of the hydraulic cylinder assembly automatically moves each of the first jaw block and the second jaw block between the open position and the closed position.

* * * * *